US006811034B2

(12) United States Patent
Chaume et al.

(10) Patent No.: US 6,811,034 B2
(45) Date of Patent: Nov. 2, 2004

(54) ACOUSTIC METHOD FOR DISCRIMINATING PAPER AND PLASTIC ENVELOPES

(75) Inventors: François Chaume, Saint Marcel les Valence (FR); Jean-Marc Teluob, Cornas (FR)

(73) Assignee: Solystic, Gentilly (FR)

( * ) Notice: Subject to any disclaimer, the term of this patent is extended or adjusted under 35 U.S.C. 154(b) by 112 days.

(21) Appl. No.: 10/220,634

(22) PCT Filed: Apr. 2, 2001

(86) PCT No.: PCT/FR01/00971

§ 371 (c)(1),
(2), (4) Date: Sep. 4, 2002

(87) PCT Pub. No.: WO01/76775

PCT Pub. Date: Oct. 18, 2001

(65) Prior Publication Data

US 2003/0038066 A1 Feb. 27, 2003

(30) Foreign Application Priority Data

Apr. 7, 2000 (FR) ..... 00 04443

(51) Int. Cl.[7] ..... B07C 5/00
(52) U.S. Cl. ..... 209/591
(58) Field of Search ..... 209/552, 576, 209/590, 591; 73/584

(56) References Cited

U.S. PATENT DOCUMENTS 3,773,321 A * 11/1973 Burroughs ..... 271/260
3,802,252 A * 4/1974 Hayward et al. ..... 73/52
5,052,875 A * 10/1991 Miller et al. ..... 414/403
5,631,426 A * 5/1997 Jao ..... 73/644
5,632,381 A * 5/1997 Thust et al. ..... 209/44.1
5,908,191 A * 6/1999 Chen et al. ..... 271/260
6,027,113 A * 2/2000 Reljic ..... 271/260
6,460,414 B1 * 10/2002 Erickson et al. ..... 73/603

FOREIGN PATENT DOCUMENTS

DE 42 17 481 A * 11/1993

* cited by examiner

*Primary Examiner*—Donald P. Walsh
*Assistant Examiner*—Joseph Rodriguez
(74) *Attorney, Agent, or Firm*—Sughrue Mion, PLLC

(57) ABSTRACT

In a machine for processing mail articles, the method of distinguishing between mail articles (P1, P2, P3) contained in envelopes made out of paper and mail articles contained in envelopes made out of plastics material, consists in displacing each mail article in front of a pressure member (5) so as to produce an acoustic signal that results from a suction effect of the pressure member on one face of said article while it moves in front of said pressure member, and in comparing said acoustic signal with a reference signal in order to detect whether the envelope of said article is made out of paper or out of plastics material.

3 Claims, 1 Drawing Sheet

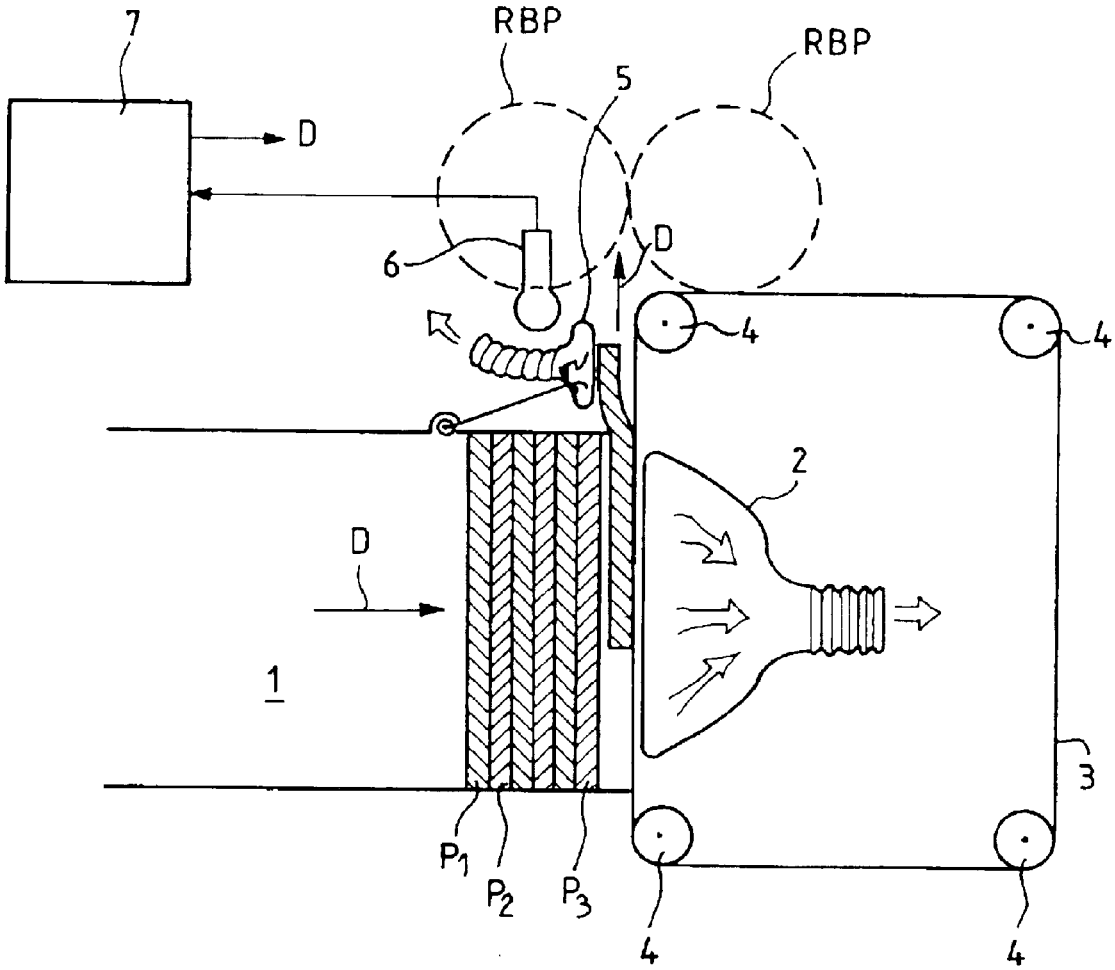
7
D
RBP
RBP
5
6
D
4
4
2
D
1
3
P1
P2
P3
4
4

ACOUSTIC METHOD FOR DISCRIMINATING PAPER AND PLASTIC ENVELOPES

BACKGROUND OF THE INVENTION

In a machine for processing mail articles, the invention relates to a method of distinguishing between mail articles contained in envelopes made out of paper and mail articles contained in envelopes made out of plastics material.

Some postal applications require bar codes to be printed on the envelopes of the postal items. In practice, the mail processed by sorting machines is packaged not only in envelopes made out of paper, but is often also packaged in envelopes made out of plastics material. Printing bar codes on envelopes made out of plastics material thus presents a problem since ink takes a long time to dry on that type of printing medium, and the printed bar codes are likely to be wiped off due to the envelopes rubbing against the sorting machines. Stickers serving as a medium for the bar codes to be printed can be put on items processed by a sorting machine, and in order to avoid putting stickers on all such items it has been envisaged to distinguish between envelopes made out of plastics material and envelopes made out of paper so that a sticker is put on an item only if it is contained in an envelope made out of plastics material.

Several techniques are already known for distinguishing between envelopes made out of paper and envelopes made out of plastics material. One known technique is based on an optical principle consisting in reflecting a beam of light onto the envelope to be inspected, and in measuring the reflected energy. Since plastics material is more reflective than paper, the distinction is simple to make. However, that technique of distinguishing by optical measurement can turn out to be ineffective when the envelopes made out of plastics material are matt and/or colored, i.e. when they have reflectance that is similar to that of paper. Another known technique is based on a pneumatic principle consisting in deforming the envelope to be inspected by suction, and in measuring a pressure variation associated with said deformation. Since an envelope made out of plastics material is generally less rigid than an envelope made out of paper, the distinction is simple to make. However, the effectiveness of that technique of distinguishing by pneumatic measurement is very sensitive to dust and therefore requires the pressure sensor to be cleaned frequently so as to maintain its measurement performance. U.S. Pat. No. 5,632,381 discloses a method of classifying sheets of paper and of card based on comparing the acoustic signal produced by tapping the sheets with a ram. Patent DE-4 217 481 proposes classifying objects made out of paper, aluminum, and plastics by electrostatic means.

SUMMARY OF THE INVENTION

The object of the invention is to propose another solution, which does not have the above-mentioned drawbacks, for distinguishing between mail articles contained in envelopes made out of paper and mail articles contained in envelopes made out of plastics material.

To this end, the invention provides a method of distinguishing between mail articles contained in envelopes made out of paper and mail articles contained in envelopes made out of plastics material, the method being characterized in that it consists in displacing each mail article in front of a pressure member so as to produce an acoustic signal that results from a suction effect of the pressure member on one face of said article while it moves in front of said pressure member, and in comparing said acoustic signal with a reference signal in order to detect whether the envelope of said article is made out of paper or out of plastics material. More particularly, according to the invention, spectral characteristics are extracted from said acoustic signal and are compared with corresponding reference values in order to detect whether the envelope of said article is made out of paper or out of plastics material. It has thus been observed that in an installation for unstacking mail articles that is provided with a dual-point separator constituted by a suction nozzle, the noise that results from the suction effect by the dual-point separator on one face of an unstacked article while said article moves in front of the suction nozzle is different depending on whether the mail article is contained in an envelope made out of paper or is contained in an envelope made out of plastics material. More particularly, spectral analysis both of the acoustic signals picked up for mail articles contained in envelopes made out of plastics material and of the acoustic signals picked up for mail articles contained in envelopes made out of paper has shown that the first acoustic signals corresponding to envelopes made out of plastics material all present a characteristic of high amplitude in a certain frequency range, which characteristic is not found in the acoustic signals corresponding to envelopes made out of paper.

BRIEF DESCRIPTION OF THE DRAWINGS

The method of the invention is described below and its implementation is shown in the sole drawing which is a diagram showing a device for unstacking mail articles with a dual-point (or multiple-point) separator constituted by a suction nozzle.

DETAILED DESCRIPTION OF THE INVENTION

The figure shows a device for unstacking postal items, said device conventionally comprising a magazine 1 loaded with a stack of postal items such as P1, P2, P3 driven in a certain direction D towards an unstacking head comprising a suction nozzle 2 in front of which there travels a perforated belt 3 engaged on guide rollers such as 4. The suction nozzle 2 exerts a suction force in the direction D which tends to press the first item of the stack loaded in the magazine 1 against the perforated belt 3, thereby causing said item to be displaced edgewise by the perforated belt in a direction D' that is perpendicular to the direction D, and to be separated from the stack.

The unstacking device shown in the figure comprises a dual-point (or multiple-point) separator constituted by a suction nozzle 5 which exerts a suction force in the opposite direction to the suction force exerted by the nozzle 2. The nozzle 5 is disposed slightly downstream from the nozzle 2 in the direction D'. As each unstacked item is displaced edgewise between the two suction nozzles 2 and 5, the suction nozzles 2 and 5 act on opposite faces of the item. The suction force of the nozzle 2 is substantially greater than the suction force of the nozzle 5 so that if a single item is engaged between the two nozzles 2 and 5, it is displaced in the direction D' by the combined action of the nozzle 2 and the belt 3. However, if two items are engaged simultaneously between the nozzles 2 and 5, the item that is next to the nozzle 5 is stopped since it is not subject to the action of the nozzle 2, while the item that is next to the nozzle 2 is displaced in the direction D' by the combined action of the nozzle 2 and the belt 3, as mentioned above.

The suction effect of the nozzle 5 on one face of a item that has been separated from the stack and that is being displaced in front of the nozzle 5 is increased when the leading edge of the item comes up to the low pressure wheels RBP (represented diagrammatically by dashed lines). This controlled and adjustable suction level generates an acoustic signal which is detected by a sensor 6 such as a microphone. The sensor 6 is preferably disposed in the vicinity of the dual-point separator and therefore in the vicinity of the nozzle 5, as shown in the figure, so as to minimize detection of other, parasitic noises that are produced by the unstacking device. The acoustic signal detected by the sensor 6 is compared with a reference signal in order to detect if the envelope of the item is made out of paper or out of plastics material. The noise level picked up and analyzed for the detection comes from the signal generated by the controlled suction. Permanent suction generates a background noise that is not meaningful for detection purposes.

In order to perform the comparison, certain representative spectral characteristics, e.g. strength of the signal, spectral lines, shape of the envelope of the signal, are extracted from the acoustic signal so as to compare them with corresponding reference values in order to detect whether the envelope is made out of paper or out of plastics material. The characteristics can be extracted easily using known methods such as filtering, digitization, and other methods of processing an acoustic signal which are performed by a data processor unit 7 such as a microcomputer or a specialized circuit outputting data D indicating whether the envelope is made out of paper or out of plastics material. The reference values for comparison purposes are constituted merely by recording acoustic signals picked up in the unstacking device for reference items contained both in envelopes made out of paper and in envelopes made out of plastics material.

What is claimed is:

1. In a machine for processing mail articles, a method of distinguishing between mail articles (P1, P2, P3) contained in envelopes made out of paper and mail articles contained in envelopes made out of plastics material, the method comprising the steps of:

displacing each mail article in front of a pressure member (5) so as to produce an acoustic signal that results from a suction effect of the pressure member on one face of said article while it moves in front of said pressure member, and comparing said acoustic signal with a reference signal in order to detect whether the envelope of said article is made out of paper or out of plastics material.

2. The method according to claim 1, in which spectral characteristics are extracted from said acoustic signal and are compared with corresponding reference values in order to detect whether the envelope of said article is made out of paper or out of plastics material.

3. A device for implementing the method according to claim 1, the device comprising:

a pressure member (5) serving as a dual-point separator in an installation for unstacking mail articles, an acoustic sensor (6) disposed in the vicinity of said dual-point separator so as to pick up the acoustic signal that results from a suction effect of said dual-point separator on one face of each unstacked mail article while it moves in front of said dual-point separator, and a data processor unit (7) which receives said acoustic signal from said sensor so as to compare it with a reference signal in order to detect whether the envelope of said article is made out of paper or out of plastics material.

* * * * *